United States Patent [19]

Cookson et al.

[11] 4,190,005

[45] Feb. 26, 1980

[54] PROCESS FOR PULVERIZING COAL USING COMBINATION GAS IN FLUID ENERGY PULVERIZERS

[75] Inventors: Donald H. Cookson, Pittsburgh; Clifford W. McCoy, Oakdale, both of Pa.

[73] Assignees: COMCO - Dravo Corporation; Electric Fuels Corporation, both of Pittsburgh, Pa.

[21] Appl. No.: 969,695

[22] Filed: Dec. 15, 1978

[51] Int. Cl.[2] ..... F23B 7/00

[52] U.S. Cl. ..... 110/347; 44/51; 110/232

[58] Field of Search ..... 44/51; 241/5; 110/347, 110/232

[56] References Cited

U.S. PATENT DOCUMENTS

| | | | |
|---|---|---|---|
| 1,532,647 | 4/1925 | Bergman . | |
| 3,241,505 | 3/1966 | Long et al. | 44/51 |
| 3,921,918 | 11/1975 | Peterson | 241/245 |
| 4,048,927 | 9/1977 | Mallek et al. | 110/237 |
| 4,057,021 | 11/1977 | Schoppe | 110/347 |
| 4,089,631 | 5/1978 | Giles | 110/347 |
| 4,104,035 | 8/1978 | Cole et al. | 44/51 |
| 4,147,116 | 4/1979 | Graybill | 110/347 |

*Primary Examiner*—Delbert E. Gantz
*Assistant Examiner*—Y. Harris-Smith
*Attorney, Agent, or Firm*—Parmelee, Miller, Welsh & Kratz

[57] ABSTRACT

Combustion gases from combustion of a coal-in-oil fuel mixture are used as an inert carrier gas in a fluid energy pulverizer used in the formation of the fuel mixture. A portion of the hot combustion gases is separated, cooled and compressed and passed to a heat exchanger where that portion is heated by the remainder of the combustion gases, the hot, pressurized portion led to the fluid energy pulverizer for use as a carrier gas for pulverizing of further coal.

5 Claims, 1 Drawing Figure

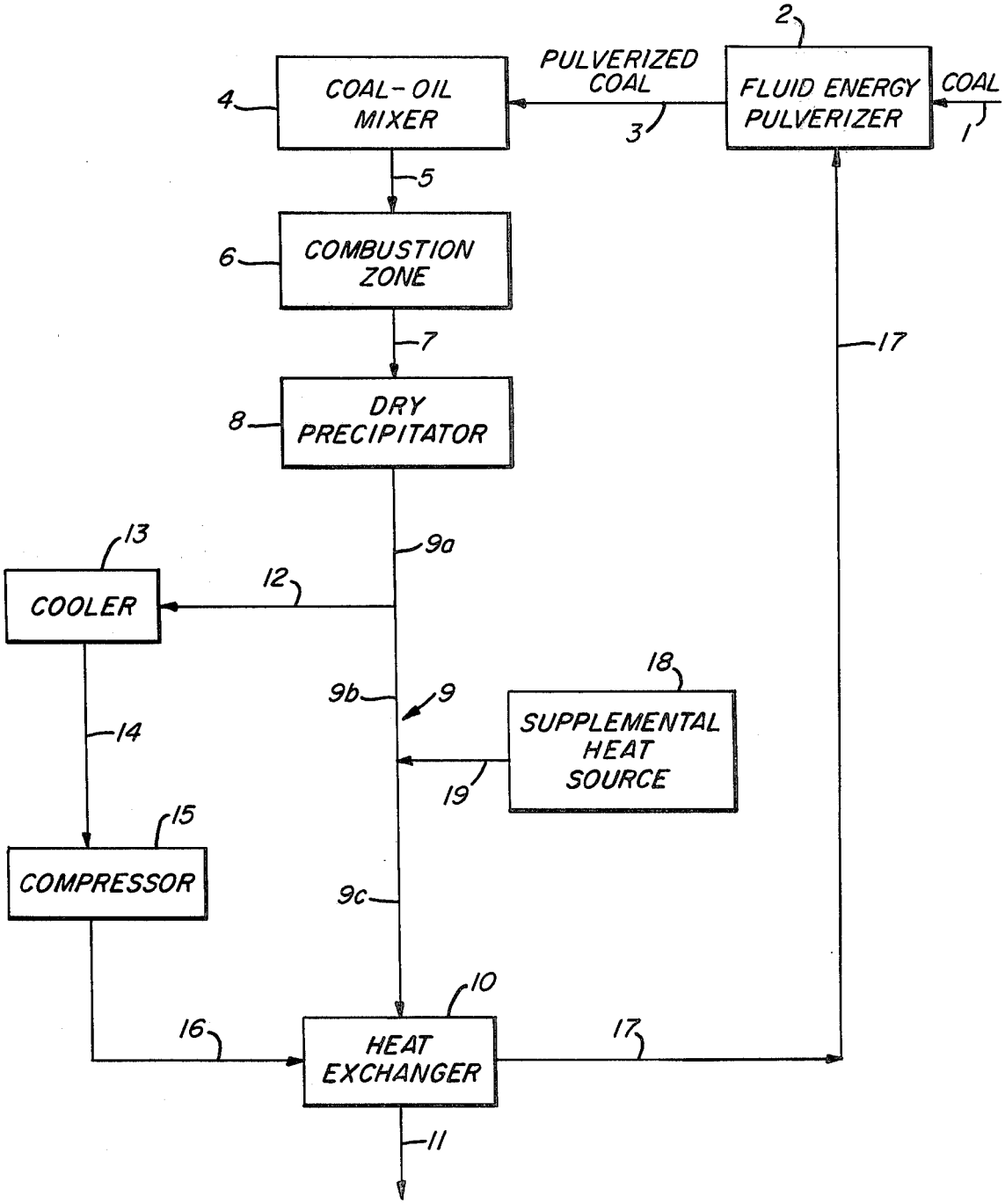
2
PULVERIZED COAL
FLUID ENERGY PULVERIZER
COAL
1
4
COAL-OIL MIXER
3
5
6
COMBUSTION ZONE
7
17
8
DRY PRECIPITATOR
13
9a
12
COOLER
18
9b
9
SUPPLEMENTAL HEAT SOURCE
14
19
15
COMPRESSOR
9c
10
16
HEAT EXCHANGER
17
11

PROCESS FOR PULVERIZING COAL USING COMBINATION GAS IN FLUID ENERGY PULVERIZERS

BACKGROUND OF THE INVENTION

Because of the limited supply of oil for use by power installations and other high capacity users of oil as a fuel, efforts have been made to substitute or supplement coal as a fuel in place of all or a portion of such oil. One such effort has involved the use of a mixture of coal and oil as a fuel for large users.

In the formation of coal-in-oil mixtures, the oil that is used in combustion systems is supplemented with finely divided coal particles. The coal particles must be of a particle size such that they form a slurry with the oil that is readily pumpable and freely flowable through burners. The coal must also be of a size that the coal particles do not settle or separate out from the oil mixture upon standing.

The pulverizing of coal particles to such a fine particle size also, of course, involves the use of energy. In order to make coal-in-oil mixtures economically feasible, cost of the energy required for such pulverizing must be minimized. Various systems have been proposed for pulverizing coal to the particle size required for stable coal-in-oil mixtures, one of which involves the use of fluid energy mills or jet mills as the pulverizing means. Such mills are well known for use in grinding or drying fine particles, and have now been found to be especially suitable for pulverizing coal.

Fluid energy mills or jet mills use the principal of high speed collision refraction of solid particles in a mill by the use of a charge of heated, pressurized fluid. Generally, a high pressure fluid, such as steam, air or other fluid, is injected through nozzles into a circular device, with the fluid expanding upon passage through the nozzles into the chamber of the mill. The solid particles that are to be pulverized are fed to the chamber and entrained in the fluid stream and swept around the chamber such that they collide with and pulverize each other. The pulverized particles of desired fine particle size are discharged from the device and entrained in spent fluid, while particles that are larger than the desired size are recycled in the chamber for further pulverizing.

The use of steam as the carrier fluid in such fluid energy pulverizing mills, while providing a carrier fluid that prevents combustion or explosion problems within the mill, is expensive annd produces problems associated with cleaning and condensing the steam.

BRIEF SUMMARY OF THE INVENTION

In the present process, combustion gases are used as a carrier gas for coal particles in a fluid energy mill, whereby coal-in-oil mixtures formed from the pulverized coal in the mill are combusted and the combustion gases so produced directed to the fluid energy mill for use in pulverizing further coal. The hot combustion gases from the combustion of the coal-in-oil mixture are passed to a heat exchanger, with a portion of the combustion gases separated from the main stream prior to contacting the heat exchanger, that portion being cooled and compressed and then passed to the heat exchanger wherein said portion is reheated by heat exchange with the residual main stream of combustion gases. The heated, pressurized portion of the combustion gases is then directed to the fluid energy mill for use as the carrier gas in pulverizing further coal for production of further coal-in-oil fuel mixture. In the preferred embodiment, supplementary heat is provided to heat the pressurized portion of combustion gases to the desired temperature for use in the fluid energy mill.

BRIEF DESCRIPTION OF THE DRAWING

The drawing is a flow chart illustrating the process of the present invention.

DETAILED DESCRIPTION

As illustrated in the attached flow diagram, coal from a source not shown is charged through line 1 to a fluid energy pulverizer 2. Pulverized coal leaves the fluid energy mill 2 and is passed by line 3 to a coal-oil mixer 4 wherein the pulverized coal is mixed with oil to form a fuel.

The coal-oil mixture is passed by line 5 to a combustion zone 6 wherein the mixture is used as a fuel to produce heat for various purposes, for example, in the production of steam to produce electricity in a power plant. The combustion of the coal-in-oil mixture in the combustion zone 6 produces hot combustion gases which are carried through line 7 to a dry precipitator 8 for removal of particulate matter therefrom. After removal of any particulate matter from the hot combustion gases, those gases pass by means of line 9 to a heat exchange unit 10. After heat exchange with a portion of recycle gases in the heat exchange unit 10, as hereinafter described, the hot combustion gases are discharged through line 11.

As illustrated in the flow chart, for a first section of line 9, section **9*a*, the total volume of cleaned hot combustion gases are maintained as a single flow of gases. A portion of those gases is separated therefrom and directed through line 12 to a cooling means 13. The remainder of the hot combustion gases, after removal of said portion through line 12, is passed through the remainder of line 9 to the heat exchange means 10**.

That portion of hot combustion gases that is directed through line 12 to the cooling means 13 is cooled therein to a predetermined temperature and carried by line 14 to a compressor 15. In the compressor, the cooled gases are pressurized so as to provide a pressurized fluid for use in the fluid energy mill. Upon exhausting the pressurized gases from the compressor 15, this portion of the combustion gases is passed by means of line 16 to heat exchange unit 10. In the heat exchange unit 10, the portion of the pressurized combustion gases that is passed through line 16 is heated by heat exchange with the remainder of the hot combustion gases charged through line 9, to heat the same and then that heated, pressurized portion of the hot combustion gases is carried by line 17 to the fluid energy pulverizer 2, for use as the carrier gas for pulverizing further coal.

Since the remainder of the hot combustion gases that are passed to the heat exchanger through line 9 may not be at a sufficiently high temperature to heat the portion of combustion gases from line 16 to the desired temperature for use in the fluid energy pulverizer, the remainder of the hot combustion gases, in section **9*b* of line 9 may be heated further. To effect such additional heating, a supplemental heat source 18, such as an oil burner, is provided, the hot gases from which are charged to line 9 and the mixture of hot combustion gases and hot gases is carried through section 9*c* of line 9 to the heat exchange unit 10**.

As an example of how the process of the present invention would operate, where an inert gas would be required at a temperature of about 600°-700° F. (315°-370° C.) and a pressure of about 150-250 psig in a fluid energy mill for pulverizing coal, the following is presented, wherein parts are parts by weight unless otherwise indicated. One part of coal is pulverized in the presence of 1.78 parts hot combustion gases, the gases being at about 370° C. and pressurized to between 150-250 psig for injection into the fluid energy mill. The one part of pulverized coal discharged from the fluid energy mill is mixed with one part of No. 6 oil. The mixture of one part pulverized coal and one part oil is combusted in a boiler with 27.77 parts of air to produce heat for energy producing purposes. Hot combustion gases from the boiler, after passing through a precipitator, would comprise about 29.69 parts at about 600° F. (315° C.) at atmospheric pressure. A portion of about 1.78 parts of hot combustion gas at 315° C. is removed from the remainder of the hot combustion gases, that portion cooled to about 100° F. (38° C.) and compressed in a compressor to about 150-250 psig. Some heating of this portion will be effected by the compressor with the gas exiting the compressor between 38°-95° C. To the remainder of the hot combustion gases, a stream of hot gases from an oil burner, burning 0.102 parts oil with 1.42 parts air, at about 3100°-3400° F. (1700°-1870° C.) is added, the mixture of the remainder of the hot combustion gases 29.43 parts being charged to a heat exchange unit. Those gases are then passed in heat exchange relationship to the portion of gas that was cooled and pressurized. The exhaust of gases from the heat exchanger would be about 29.43 parts gas at about 767° F. (410° C.) on the one hand while, on the other hand, 1.78 parts of hot combustion gas at about 370° C. would be returned to the fluid energy mill for use in pulverizing an additional one part coal.

These values would, of course, vary depending upon the type of coal being pulverized, the type of oil being mixed therewith, and the desired temperature and pressure of the carrier gas injection into the fluid energy mill. The results would, however, be consistent in that a normally wasted combustion gas can be used in the coal pulverizing as the inert gas of the fluid energy pulverizer.

We claim:

1. In a process for pulverizing coal to form a coal-oil mixture and combusting said mixture to produce heat, wherein coal and a carrier gas stream, said carrier gas stream being at an elevated temperature and under superatmospheric pressure, are charged to a fluid energy pulverizer, with pulverized coal therefrom mixed with oil to form the coal-oil mixture, and hot combustion gases are produced by the combusting of the mixture, the improvement wherein:

said hot combustion gases are directed to a heat exchange unit;

a portion of said hot combustion gases are separated from the remainder thereof prior to reaching the heat exchange unit;

said portion of hot combustion gases is cooled, compressed and redirected to said heat exchange unit for heat exchange with said remainder of the hot combustion gases; and said resulting heated, compressed portion of combustion gases is charged to the fluid energy pulverizer as said carrier gas for pulverizing of further coal.

2. In the process defined in claim 1, the improvement wherein supplemental hot gases are produced and admixed with said remainder of the hot combustion gases prior to heat exchange with said portion of cooled, compressed hot combustion gases.

3. In the process defined in claim 2, the improvement wherein said supplemental hot combustion gases are produced by combustion of oil.

4. In the process defined in claim 1, the improvement wherein said carrier gas stream is at a temperature of 315°-370° C. and a pressure of about 150-250 psig.

5. In the process defined in claim 4, the improvement wherein said portion of hot combustion gases is cooled to about 38° C. and compressed to a pressure of about 150-250 psig prior to being redirected to said heat exchanger.

* * * * *